US006582041B1

(12) United States Patent
Tsuruoka

(10) Patent No.: US 6,582,041 B1
(45) Date of Patent: Jun. 24, 2003

(54) PRINTING HEAD, PRINTING APPARATUS AND PRINTING METHOD

(75) Inventor: Yuji Tsuruoka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/216,715

(22) Filed: Dec. 21, 1998

(30) Foreign Application Priority Data

Dec. 19, 1997 (JP) ..... 9-351526

(51) Int. Cl.[7] ..... B41J 29/38
(52) U.S. Cl. ..... 347/12; 347/14
(58) Field of Search ..... 347/5, 12, 15, 347/41

(56) References Cited

U.S. PATENT DOCUMENTS

| | | | | |
|---|---|---|---|---|
| 4,097,873 A | | 6/1978 | Martin | 347/3 |
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,739,415 A | * | 4/1988 | Toyono et al. | 358/296 |
| 4,740,796 A | | 4/1988 | Endo et al. | 347/56 |
| 6,168,263 B1 | * | 1/2001 | Nojima et al. | 347/54 |
| 6,196,662 B1 | * | 3/2001 | Voelker et al. | 347/40 |

FOREIGN PATENT DOCUMENTS

| | | | |
|---|---|---|---|
| EP | 0 692 386 | 1/1996 | B41J/2/505 |
| EP | 0 698 492 | 2/1996 | B41J/2/05 |
| EP | 0 719 647 A3 | 7/1996 | B41J/2/21 |
| EP | 0 719 647 A2 | 7/1996 | B41J/2/21 |
| EP | 0 730 969 | 9/1996 | B41J/2/21 |
| EP | 0 763 432 | 3/1997 | B41J/3/44 |
| EP | 0 816 103 A3 | 1/1998 | B41J/2/505 |
| EP | 0 816 103 A2 | 1/1998 | B41J/2/505 |

* cited by examiner

*Primary Examiner*—Huan Tran
*Assistant Examiner*—Alfred E Dudding
(74) *Attorney, Agent, or Firm*—Fitzpatrick, Cella, Harper & Scinto

(57) ABSTRACT

A print head capable of printing with different resolutions includes a plurality of printing elements for applying printing agent on a printing material, wherein the print head is movable relative to the printing material in a moving direction; and drive timing changing means for changing drive timing of the printing elements in accordance with the print resolution to change print pitch in the moving direction.

19 Claims, 9 Drawing Sheets

PRINTING HEAD, PRINTING APPARATUS AND PRINTING METHOD

FIELD OF THE INVENTION AND RELATED ART

The present invention relates to a printing head, a printing apparatus which employs a printing head, and a printing method which employs a printing head.

In the past, a printing apparatus for printing an image on printing medium such as paper, fabric, plastic sheet, and OHP sheet (hereinafter, simply "recording paper") has been embodied in the form of an apparatus in which one of various printing heads based on the wire dot system, thermal system, thermal transfer system, or ink jet system can be mounted.

The ink Jet printing system prints an image on a sheet of recording paper by ejecting ink from ink ejection orifices. In other words, it is not an impact type printing system, and therefore, the printing noise it produces is substantially low. Thus, a printing apparatus based on the ink jet printing system (hereinafter, "ink jet printing apparatus") can print a high density image at a high speed.

In recent years, demand has been rapidly increasing for higher speed and precision, and therefore, it has become common that an ink jet printing head is provided with a large number of ink ejection nozzles, the orifices of which are arranged as illustrated in FIG. 1. As for the ink ejecting systems for an ink jet printing head, there are those which use thermal energy, and those which use mechanical energy. In the case of the former, a heat generating member (heater) such as an electrothermal transducer is driven to generate heat which generates bubbles in ink, and the bubbles eject ink. In the case of the latter, a piezoelectric element is employed as an ejection energy generating element (recording element), and the contraction of the element which occurs as the element is driven is used to eject ink.

Both the printing head which employs the former, and the printing head which employs the latter, suffer from certain problems. That is, if a printing head is designed so that all the elements are driven at the same time, cross talk or the like occurs, which changes the amount of ink per ejection, reducing print quality. Further, in order to drive all the elements at the same time, a power source with a capacity large enough to instantly flow a large amount of electrical current is required. There are solutions to these problems. According to one of the solutions, for example, the large number of ink ejection nozzles (which comprises an ink ejection orifice, a liquid flow path, an ejection energy generating element, and the like) are divided into a plurality of blocks, each of which comprises a predetermined number of ejection nozzles. In operation, each ejection nozzle in each block, being correspondent to an ejection nozzle orifice in the rest of the blocks, in terms of the ordinal position in its own block, is caused to eject ink at the same time as the ordinally correspondent ejection nozzles in the other blocks. Further, the ejection nozzles in the same block are caused to sequentially eject ink.

More specifically, referring to FIG. 1, (A), a printing head 1 is provided with a large number of ink ejection nozzles 2, which are divided into blocks, each of which comprises 16 nozzles. In operation, ordinally correspondent nozzles in all blocks (for example, the first, seventeenth, thirty-third, and so on, in terms of the order inclusive of all the nozzles), are driven at the same time, and the nozzles in each block are sequentially driven. In other words, every sixteenth nozzle, is driven at the same time, and therefore, the ink ejection of each nozzle is not affected by the ink ejection by the adjacent nozzles, that is, cross talk is minimized However, if printing is done by using the above described block based sequential driving method while moving a printing head, the ejection orifices of which are aligned in the direction parallel to the secondary scanning direction (direction in which printing head and printing medium are moved relative to each other), in the primary scanning direction different from the direction in which the ejection orifices are aligned, the dots formed by the ink ejection from 16 nozzles in each block align at an angle, as illustrated in FIG. 1, (A).

This problem has been dealt with by aligning the orifices of the ink ejection nozzles at an angle proportional to the degree of the staggering of the time at which each nozzle in each block is driven, in other words, by mounting the printing head at an angle relative to the secondary scanning direction, so that the direction in which the dots formed by the staggered ink ejection align, becomes parallel to the secondary scanning direction. However, if this method is used, it is difficult to realize two or more degrees of resolution in terms of the primary scanning direction, by controlling the angle at which the orifices of the ink ejection nozzles are aligned, and/or by controlling the length of the intervals between the adjacent points in time at which the nozzles in each block are sequentially driven Thus, in the case of a printing apparatus which uses this method, it is common that only the pitch at which a printing head is moved in the secondary scanning direction can be adjusted, and therefore, resolution can be adjusted in terms of only the direction parallel to the secondary scanning direction.

Obviously, image quality is further improved if resolution is increased in the primary scanning direction as well as the secondary scanning direction. However, when the frequency at which a printing element such as the electrothermal transducer or piezoelectric element is fixed, the scanning speed of a printing head in the primary direction must be reduced in order to increase resolution, and therefore, the throughput of the printing apparatus reduces.

Some printed images require a high degree of resolution, for example, images used in medical fields, and some images are required to be printed at a high speed instead of being printed at a high degree of resolution. In other words, the requirement in terms of resolution varies depending on the usage of the printed images.

Thus, the primary object of the present invention is to provide a printing apparatus which is simple in structure and yet is capable of satisfying users in terms of resolution, throughput, and the like.

SUMMARY OF THE INVENTION

A printing head in accordance with the present invention which accomplishes the above described object is characterized in that it comprises a plurality of printing nozzles for adhering printing agent to printing medium, can be driven at various speeds so that various degrees of resolution can be realized, and moves relative to the printing medium as it adheres the printing agent to the printing medium, and also that it comprises a timing adjusting means for adjusting the timing with which the printing elements are driven in response to the selected resolution so that the physical intervals between the two adjacent dots in terms of the direction in which the printing head scans the printing medium can be controlled.

Further, the printing apparatus is provided with a driving means which divides the plurality of printing nozzles into a plurality of blocks which comprises a predetermined number of printing nozzles, and is capable of driving the plurality of blocks in continuous sequence, as well as driving the printing elements in each block at the same time, and the aforementioned driving timing adjusting means is enabled to adjust the printing element driving timing by adjusting the number of the blocks into which the plurality of the printing nozzles are divided by the driving means.

Further, the printing apparatus may be provided with a means for adjusting the amount by which the printing agent is adhered, per ejection, to the printing medium by the plurality of printing elements, in response to the adjustment in the driving timing.

More specifically, each of the plurality of printing nozzles is provided with a plurality of means for generating energy for adhering the printing agent to the printing medium, and the amount by which the printing agent is adhered to the printing medium is adjusted by selectively driving the plurality of these energy generating means by the aforementioned means for adjusting the ink amount.

Further, the printing apparatus in accordance with the present invention may be provided with an additional means which is capable of carrying out the above described plurality of printing operations different in the driving timing for the printing elements, and/or one or more of other printing operations, and also is capable of carrying out one or more printing operations externally selected from among the above described printing operations, in response to an external signal which specifies at least one of the above described printing operations.

The signal which specifies the printing operation may be enabled to double as a signal which changes resolution by changing the aforementioned driving timing for the printing elements.

The printing apparatus may be provided with means other than the means for changing the driving timing for the printing elements, for example, a means for reading an image.

The means for receiving the external signal which specifies the printing operations may be such a signal receiving means that can double as a signal outputting means.

The aforementioned printing nozzles are provided with ejection orifices through which ink as the printing agent is ejected to be adhered to the printing medium, and a means for generating the energy to be used for ejecting the ink. The printing head is constituted of an ink jet printing head.

The means for generating the energy to be used for ejecting the ink may be provided with one or more electrothermal transducers which generates thermal energy as electrical current flows through them. In this case, the ink is ejected from the ejection orifice with the use of the so-called film boiling caused in the ink by the thermal energy applied to the ink by the electrothermal transducer.

The printing apparatus in accordance with the present invention is characterized in that it comprises a printing head mounting means for mounting any of the aforementioned printing heads into the main assembly of the printing apparatus, and a means for moving, relative to the printing medium, the printing head mounting means in the direction different from the direction in which the orifices of the plurality of printing nozzles are aligned.

Further, the printing apparatus may be provided with a means for providing the printing head with signals which change the driving timing for the printing elements.

The printing system in accordance with the present invention is characterized in that it comprises a means for supplying an image forming apparatus in accordance with the present invention with image formation data, and a means for setting the degree of resolution at which the image formation data are embodied in the form of a printed image.

The printing method in accordance with the present invention is characterized in that it moves, relative to the printing medium, any of the aforementioned printing heads in the primary scanning direction different from the direction in which the orifices of the plurality of printing nozzles are aligned, and changes the timing, with which the plurality of printing elements are driven, in response to the resolution set by an operator.

The printing apparatus in accordance with the present invention is characterized in that it comprises a means for moving, relative to the printing medium, the printing head which has a plurality of printing elements for adhering the printing agent to the printing medium, and a driving timing changing means for changing the intervals, in terms of the moving direction of the printing head, between the adjacent two dots to be formed, in accordance with the selected resolution, by changing the driving timing for the printing elements.

The printing method in accordance with the present invention is characterized in that it employs the printing head, which has a plurality of printing nozzles for adhering the printing agent to the printing medium, can be driven in accordance with different degrees of resolution, and prints an image while being moved relative to the printing medium, and also that it can change the intervals, in terms of the moving direction of the printing head, in accordance with the selected resolution, by changing the driving timing for the printing elements in accordance with the selected resolution In this specification, "printing" or "recording" means not only forming (printing) patterns with a specific meaning, for example, letters or the like, but also general patterns with no specific meaning, on a piece of printing medium. The "printing medium" means not only such paper that is generally used with a recording apparatus, but also fabric, plastic film, metallic plate, and the like, in other words, any such medium that can take printing agent, for example, ink, processing solution, or the like, ejectable from the printing head.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENT

Hereinafter, the present invention will be described with reference to the drawings.

Embodiment 1

(1) Description of Printing Apparatus

Figure 2:
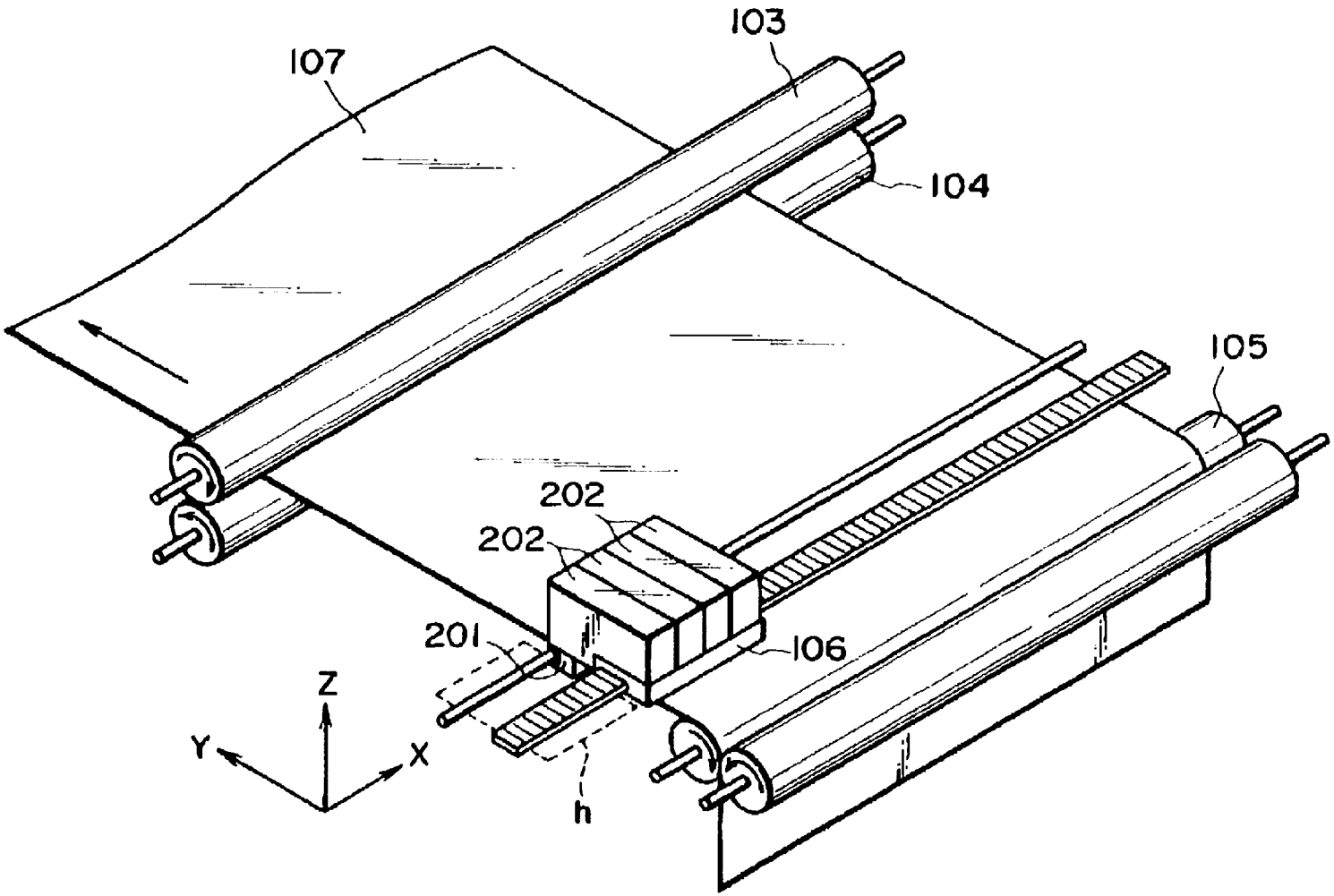
FIG. 2 is a perspective view of the essential portion of the ink jet printing apparatus in the first embodiment of the present invention, and depicts the general structure thereof.

FIG. 2 depicts the general structure of a color ink jet recording apparatus as a printing apparatus to which the present invention is applicable.

In the drawing, a referential character 202 designates a head cartridge, which consists of an ink container, which stores ink, and a printing head 201, which ejects the ink. In this embodiment, the printing apparatus is provided with a total of four head cartridges 202, one for each of four color inks: yellow ink, magenta ink, cyan ink, and black ink. Obviously, the number of the head cartridges 202 does not need to be limited to four; it may be any reasonable number, so that a plurality of inks of different color and density (hereinafter, color and density may be referred to as "tone") necessary for optimum printing results can be ejected.

As for the forms of the printing head and the ink container, they may be integral, and when the ink in the ink container runs out, or in the like instances, the entire head cartridge is exchanged, or they may be made separable so that the ink container is exchangeable independently from the printing head. Further, they may be directly connected to each other, or the ink container may be located separately from the printing head so that the ink is supplied to the printing head through a piece of tube or the like, which connects them. With the provision of the above described features of the printing head, when the inks of different densities are wanted, a plurality of ink containers which contain inks different in color density can be used, or a combination of an ink container and an ink diluting means can be used. In the case of the latter, the ink container contains an ink with higher color density, and the ink diluting means dilutes the ink with higher color density to a desired color density level at a point in the ink supply path from the high color density ink container to the printing head for ejecting the ink with lower color density. Further, it is not mandatory that the head cartridge is provided for each ink of different tone. That is, the printing means may be provided with a single ink ejection portion capable of ejecting a predetermined number of inks different in tone.

A referential character 103 designates a sheet conveying roller. It rotates in the direction indicated by an arrow mark to convey a printing paper 107 in the direction indicated by an arrow mark Y (secondary scanning direction), pinching the printing paper 107 in coordination with an auxiliary roller 104, and also flattens the printing paper 107, across the portion which is facing the printing head 201, in coordination with a roller 105. A referential character 106 designates a carriage, which carries six head cartridges 202 or printing heads 201, and shuttles in the direction indicated by an arrow mark X (primary scanning direction) when printing. The carriage 106 is controlled so that when the printing apparatus is not in a printing operation, for example, when the printing apparatus is restoring the printing performance of the printing head, it remains at the home position outlined by a broken line in the drawing.

The portion of the printing apparatus at which the printing performance of the printing head is restored is provided with a capping means for capping the printing head 201, on the side (surface provided with ink ejection orifices) which faces the printing medium, and a performance restoration unit which performs the so-called performance restoration operation, that is, removes the ink having increased viscosity, bubbles, and the like, from the printing head while keeping the printing head capped with the capping means. Adjacent to the capping means, a cleaning blade or the like is supported, being enabled to be projected toward the printing head, so that it can be placed in contact with the printing head, on the surface across which the ink ejection orifices are located. With the provision of the above described structural arrangement, the unwanted ink droplets, contamination, and the like, on the ink ejection surface can be wiped away as the printing head moves, by projecting the cleaning blade into the moving path of the printing head after the performance restoration operation.

Figure 3:
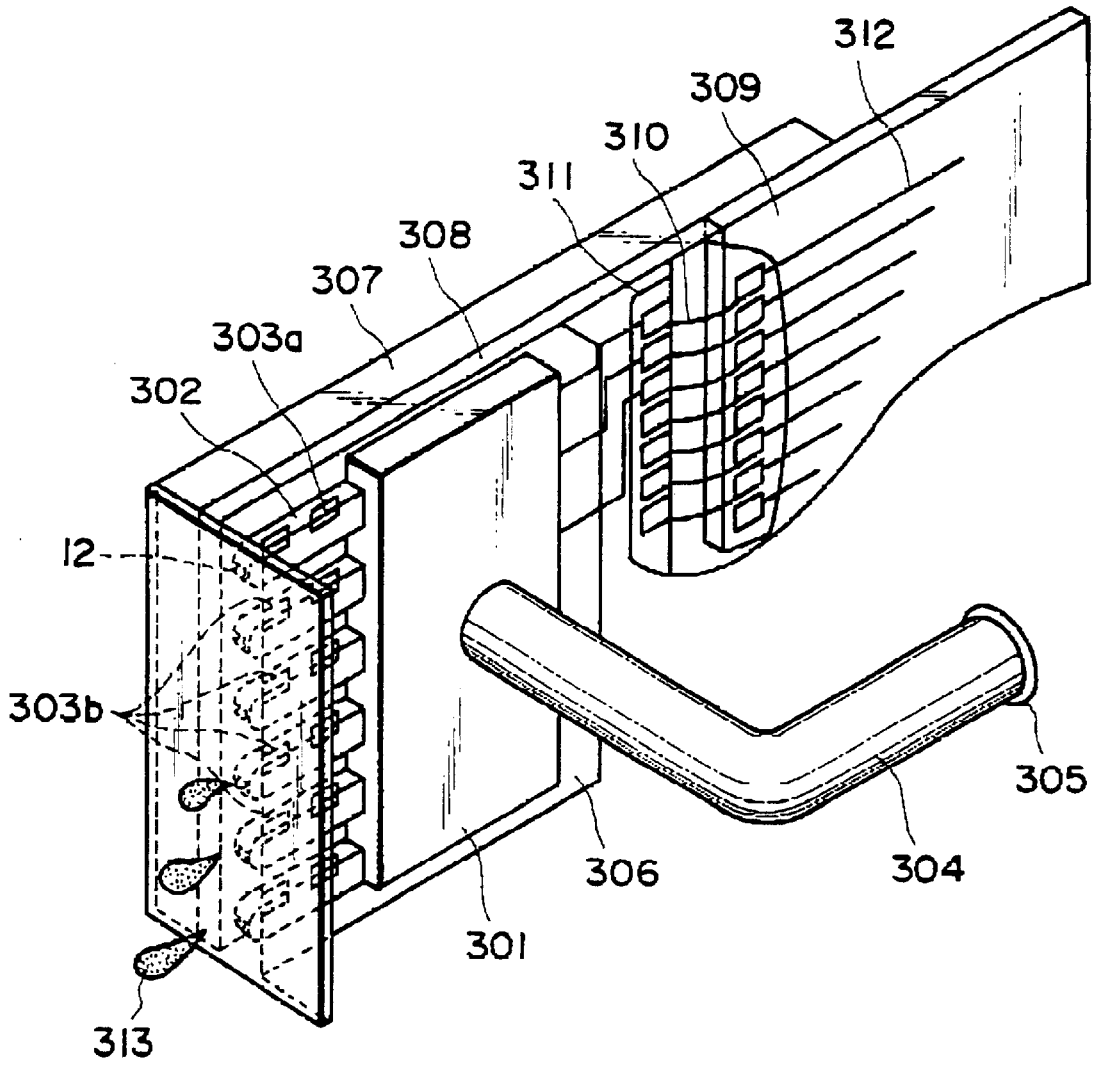
FIG. 3 is a schematic perspective view of the essential portion of a printing head compatible with the apparatus illustrated in FIG. 2.

As a start signal is inputted, the carriage 106 which remained at the position (home position) illustrated in the drawing begins to move in the X direction, or the primary scanning direction, and as the carriage 106 moves, the printing elements, with which the printing head 201 is equipped, are driven, printing patterns on the printing medium, in a stripe, the width of which equals the length of the line constituted of the aligned ejection orifices. As the carriage 106 reaches the end of the printing range in terms of the primary scanning direction, it returns to the home position to repeat the printing movement in the X direction. Between a given and the following scanning movements of the carriage 106 in the primary direction, the sheet conveying roller 103 is rotated in the direction indicated by an arrow mark to convey the printing medium in the Y direction by a predetermined distance. The movement of the carriage 106 in the primary scanning direction for printing, and the conveying of the printing medium in the secondary scanning direction, are alternately repeated until a desired image is completed on the printing medium. The ink ejecting action of the printing head 201 is controlled by an unillustrated controlling means (2) Description of Printing Head FIG. 3 is a schematic perspective view of the main portion of the printing head compatible with the apparatus illustrated in FIG. 2.

Figure 6:
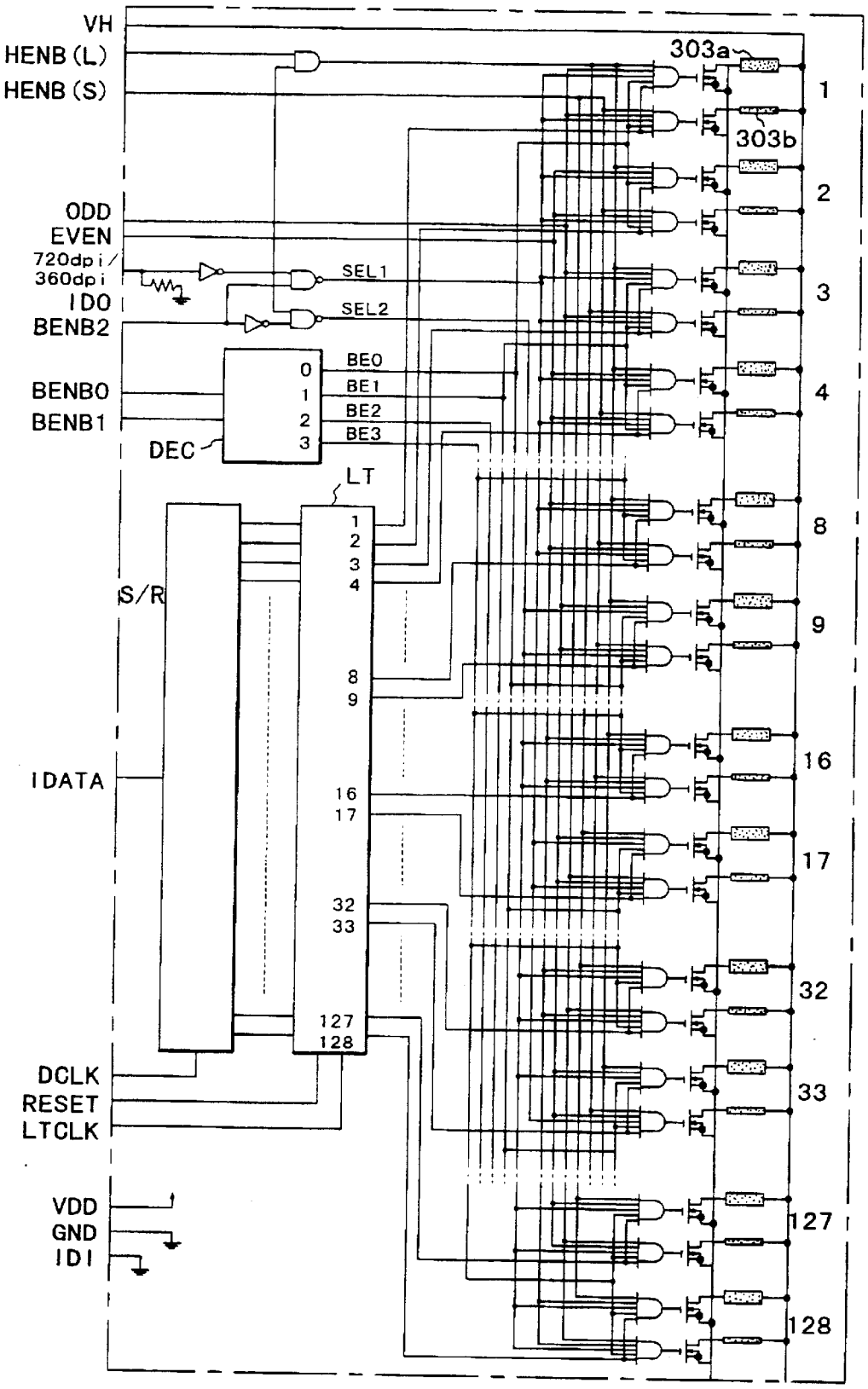
FIG. 6 is a diagram of the logic circuit which is placed in the printing head in the first embodiment of the present invention, to drive the printing head.

The printing head 201 is provided with a plurality (128 in this embodiment) of ejection orifices, which are aligned at a predetermined pitch. Each ejection orifice is connected to a common liquid chamber 301 through a liquid path 302. One of the side walls of each liquid path 302 is provided with two elements 303*a* and 303*b* (electrothermal transducers, which, hereinafter, will be referred to as "ejection heaters") for generating the energy (for example, thermal energy) to be used for ink ejection. The elements 303*a* and 303*b*, the circuit for driving them, and the like, which will be described later with reference to FIG. 6, are formed on a piece of substrate formed of silicon, with the use of semiconductor manufacturing technology. A piece of silicon plate 308 on which these elements, the circuit for driving the elements, and the like, have been formed, is glued to an aluminum heat dissipation plate 308, being supported thereby. Circuit contact electrodes 311 on the silicon plate 308 and the contact electrodes on a print plate 309 are connected with microscopically fine wires 310, and the signals from the printing apparatus main assembly are received through a signal circuit 312.

The liquid paths 302 and the common liquid chamber 301 are located under a plastic cover 306 formed by ejection molding. The common liquid chamber 301 is connected to an ink container through a joint pipe 304. The joint pipe 304, or the ink outlet portion of the ink container, is provided with an ink filter 305, so that ink is supplied to the common liquid chamber after impurities in the ink are properly filtered out.

The ink which is supplied from the ink container and is temporarily stored in the common liquid chamber 301 advances through the liquid path due to capillarity, and remains therein, forming a meniscus at the ejection orifice 300 after filling the liquid path 302. With the printing head being in this state, electrical power is supplied to the electrothermal transducer 303 through the electrodes (unillustrated), causing the electrothermal transducers 303 to generate heat, which virtually instantly heats the portion of ink in contact with the elements 303, generating a bubble in the liquid path 302. Then, as the bubble rapidly expands, the ink is ejected from the ejection orifice 12 in the form of an ink droplet 313.

(3) Description of Control System

Figure 4:
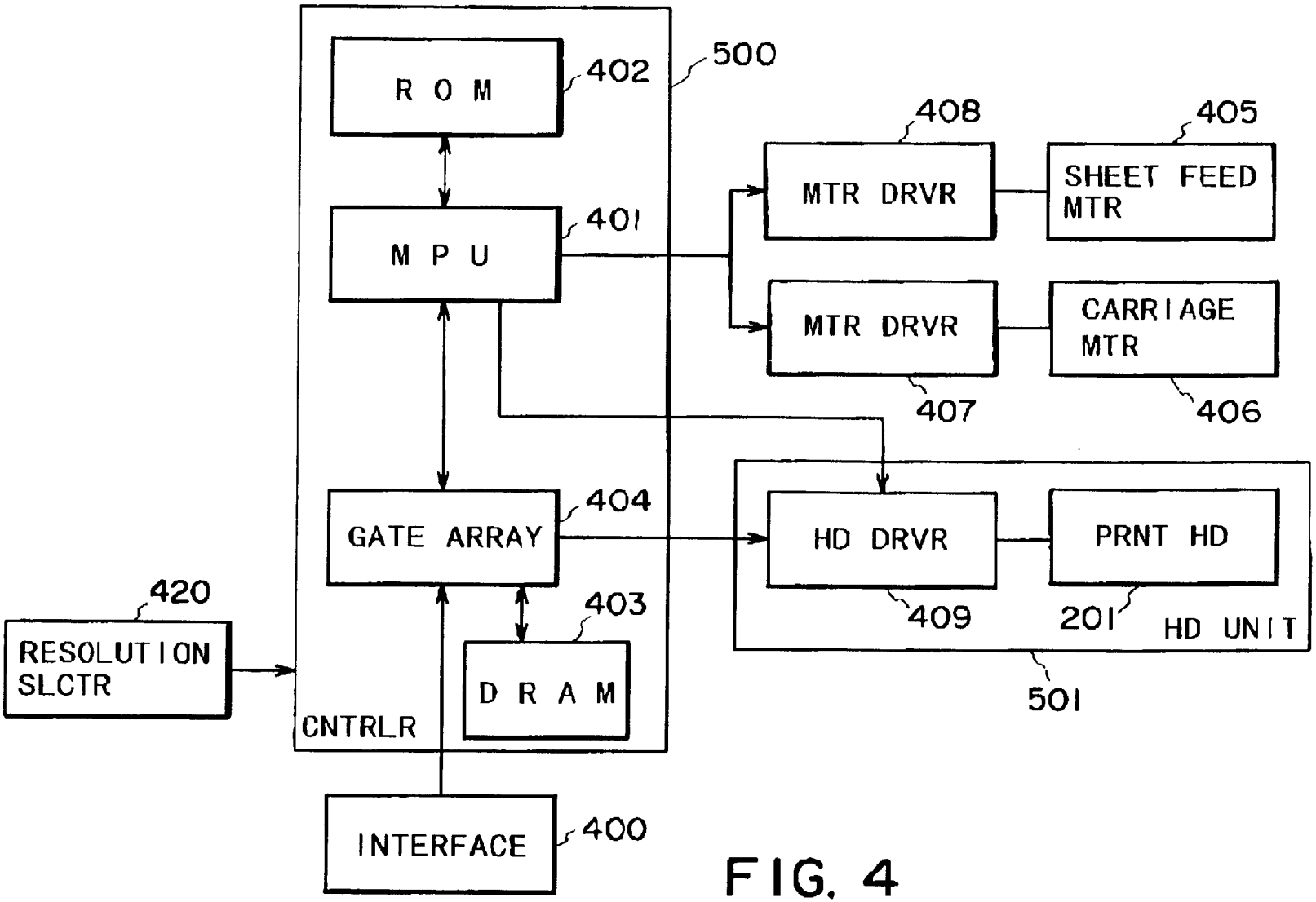
FIG. 4 is a block diagram for the control system which controls the operations, inclusive of the printing operation, of the apparatus illustrated in FIG. 2.

FIG. 4 is a diagram of the control system for controlling the various portions of the apparatus illustrated in FIG. 2, as well as the actual printing operation. In the drawing, referential characters 500 and 501 designate a printing control portion and a head portion, respectively. A referential character 400 designates an interface through which printing data are sent or received between an unillustrated host apparatus and the printing apparatus, and a referential character 401 designates an MPU, or the main control section of the apparatus. A referential character 402 designates an ROM which stores fixed data such as programs pertinent to the control procedures carried out by the MPU, and the like, and a referential character 403 designates a dynamic RAM (DRAM) which stores various data (control signals for printing operations, printing data to be supplied to the printing head 201, and the like). The dynamic RAM may be enabled to store the number of print dots, the number of printing heads, the number of cartridge exchanges, and the like.

Figures 1A, 1B:
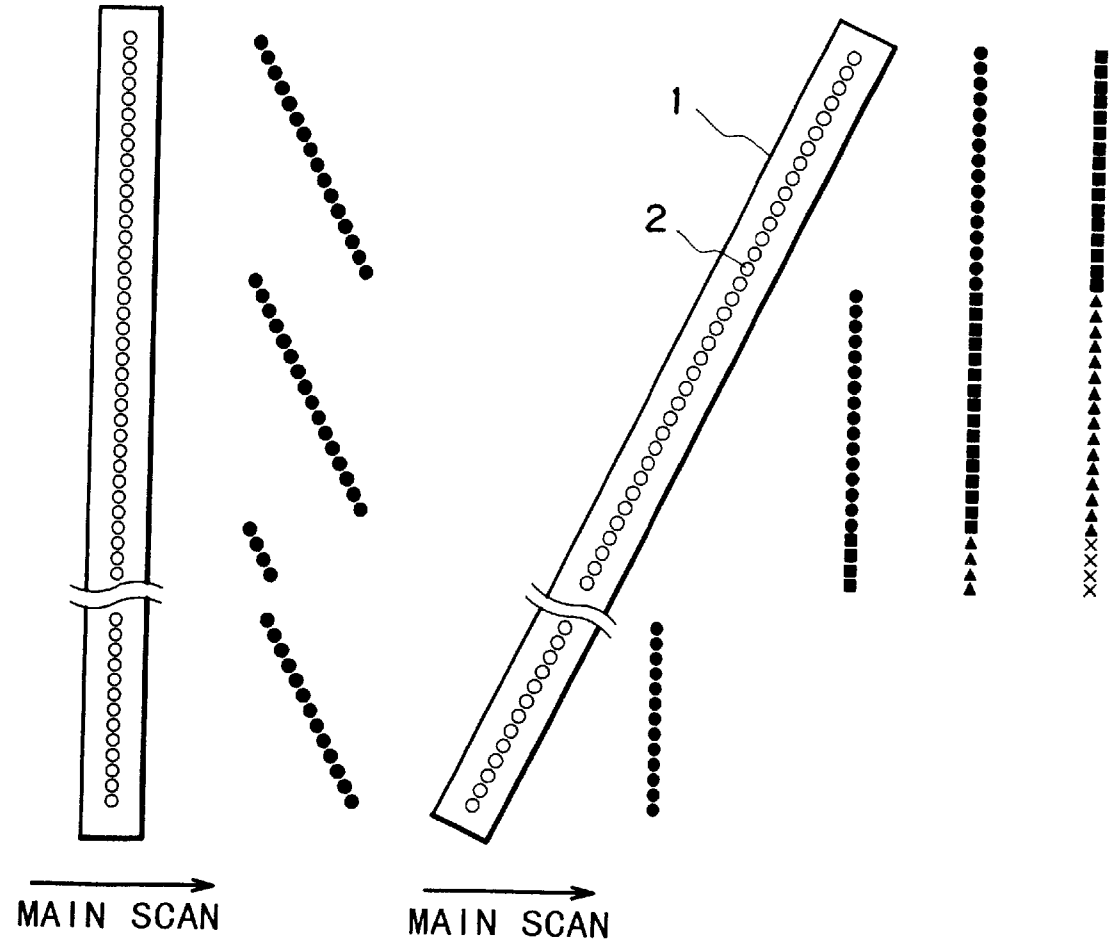
FIGS. 1, (A) and (B), are drawings which depict a printing system based on a conventional printing head.

A referential character 404 designates a gate array which supplies the printing head 201 with the printing data, and also controls the data. The gate array 404 also transfers data among the interface 400, the MPU 401, and the DRAM, and also controls the data. A referential character 406 designates a carriage motor which constitutes a driving power source for moving the carriage in the X direction in FIG. 1, and a referential character 405 designates a sheet conveying motor which constitutes the driving power source for conveying the sheets in the Y direction in FIG. 1. Referential characters 407 and 408 designate motor drivers for driving the carriage motor 406 and the sheet conveying motor 405, respectively, and a referential character 409 designates a head driver which drives the printing head 201.

A referential character 420 designates a resolution selecting means (two resolutions in this embodiment: 360 dpi and 720 dpi). The resolution selecting means may be in the form of a switch disposed on the printing apparatus main assembly side, or may be in the form of a system which sets the resolution of the printing apparatus in response to the resolution signals sent in from the host apparatus side (host computer, reader, or the like, as image formation data source) through the interface 400. In the case of the latter form, the resolution signals may be such signals that actually set, or change, the resolution of the printing apparatus, or may be in the form of resolution data included in the supplied image formation data.

Regarding the signals transmitted to pertaining portions of the apparatus by the control portion 500 to set the resolution of the printing apparatus, the printing apparatus may be provided with a hardware dedicated for transmitting the resolution signals, or they may be created and transmitted in one of the control processes carried out by the MPU.

The resolution selecting means may be set up so that each piece of printing medium can be printed with a degree of resolution different from the degrees of resolution for the other pieces of printing medium, and also, different parts of the same image can be printed at different degrees of resolution. Thus, when a page consisting of image portions which require a high degree of resolution, and text portions which do not require the high degree of resolution, is printed, specific degrees of resolution can be separately selected for the former and the latter.

(4) General Description of Printing Operation

Figures 5A, 5B:
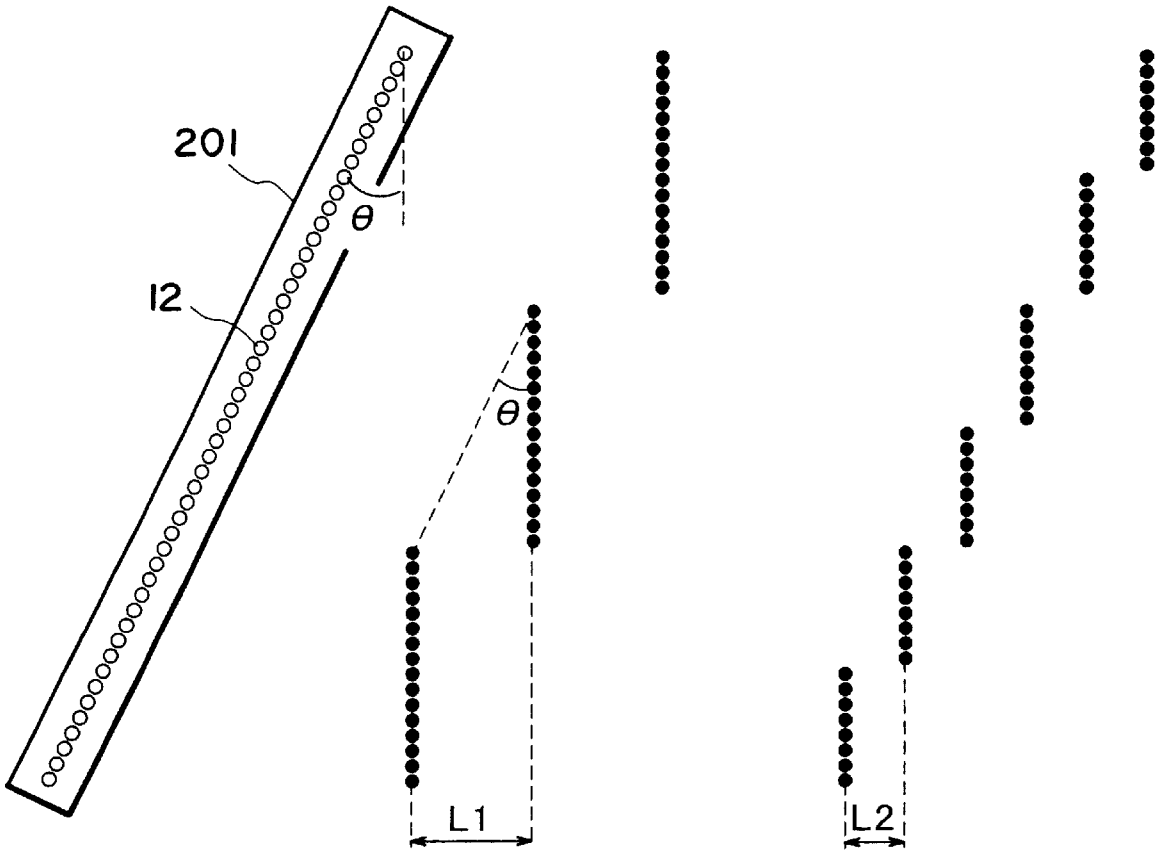
FIG. 5 is a drawing which depicts the general structure, positioning, and printing operation, of the printing head in the first embodiment of the present invention.

FIG. 5 is a drawing which depicts, in general terms, the structure, positioning, and operation of the printing head. The illustrated printing head 210 is enabled to print at two different degrees of resolution, for example, 360 dpi and 720 dpi, in terms of the primary scanning direction.

FIG. 5, (a) depicts how the dot arrangement looks when the resolution of 360 dpi is specified. In this case, a head driving method in which every sixteenth nozzle is driven at the same time like the printing head illustrated in FIG. 1, (B), was used. When ink is ejected from all sixteen consecutive ejection orifices of all ejection groups, the distance L1 between the line formed by one ejection group and the line formed by another ejection group immediately adjacent thereto, in the primary scanning direction, is approximately 70 $\mu$m, being proportional to the resolution of 360 dpi in the primary scanning direction. Further, if the pitch at which the ejection orifices are disposed is 360 orifices per inch, the distance between two adjacent ejection orifices is also approximately 70 $\mu$m. Therefore, the angle θ of the line, in which the ejection orifices of the printing head are aligned, relative to the secondary scanning direction, can be obtained by the following formula:

$$\theta = \text{acr tan}\,(1/16) \approx 3.57 \text{ (degrees).} \qquad \text{[Math. Formula 1]}$$

FIG. 5, (b) depicts the dot arrangement when an image is printed at the resolution of 720 dpi. In this case, the distance L2 between the lines formed by the adjacent two ejection groups becomes approximately 35 $\mu$m, that is, a half of L1, being proportional to the resolution of 720 dpi in terms of the primary scanning direction. Since the dot lines illustrated in FIG. 5, (a) and (b), are printed by the same printing head, the angle θ of the line formed by the ejection orifices, and the ejection orifice pitch, are the same for both degrees of resolution.

Thus, in this embodiment, in order to realize: L2=L1/2, the number of ejection nozzles in each of ejection groups into which 128 ejection nozzles are divided, or the number of nozzles in one group is reduced from 16 for the resolution of 360 dpi to 8 (number of nozzles which are driven at the same time, or number of ejection nozzles, is changed from 8 to 16, that is, the number of the ejection groups doubles). It should be easily understandable that a resolution of 1440 dpi, 2880 dpi, or the like, can be realized by further decreasing the number of nozzles per ejection group.

Further, each ejection nozzle of the printing head in this embodiment is provided with two ejection heaters 303*a* and 303*b*, a large one and a small one, respectively, which are located in the liquid path of the nozzle. When printing is done at the resolution of 360 dpi, both heaters are driven to increase the amount by which the ink is ejected, so that relatively large ink dots are formed, whereas when printing is done at the resolution of 720 dpi, only the small heater is driven to reduce the amount by which the ink is ejected, so that relatively small ink dots are formed. With this arrangement, ink dots are formed in the proper size for the specified degree of resolution.

It should be noted here that "heater size" means heater dimension in terms of the direction parallel to the heater board, that is, the size of the heater surface which comes in contact with the ink, as well as the direction perpendicular to the heater board, that is, heater thickness.

It is obvious that the positional relationship between the large and small heaters in the liquid path may be adjusted so that as the heaters are driven, ink is ejected in a specific manner, and produces ink dots with a specific diameter. The two heaters may be of the same size if it is possible to specify ink dot diameter by adjusting the positional relationship between the two heaters. In other words, the two heaters may be different, or the same, in terms of physical size. All that is necessary is that each nozzle is provided with a pair of heaters which can be driven, selectively or together, to adjust the amount by which ink is ejected, so that the ejected ink forms dots with a desired diameter.

The number of heaters may be three or more. Further, the printing head does not need to be structured exactly as described above. For example, each ejection orifice may be connected to a pair of ink paths, each of which is provided with a single heater, or all nozzles may be provided with a single heater, and paired so that the ink droplets ejected by the pair land on virtually the same spot. Also in these cases, the measurements and numbers of liquid paths and heaters must be properly set to enable the printing head to perform required tasks.

Further, the basic concept of the present invention is also compatible with the printing head in which each ejection orifice is served by only a single heater, the shape, thickness, and the like, of which are properly set so that the amount by which ink is ejected per ejection, or the ink dot diameter, can be adjusted by controlling the amount of electrical current supplied to the heater, which determines the bubble generation location, and the bubble volume.

In the case of the printing head in this embodiment, the ejection orifice alignment pitch is 360 dpi. Therefore, if an image is printed at the resolution of 360 dpi in terms of the primary scanning direction, the resolution of the image in terms of the secondary scanning direction also becomes 360 dpi. Thus, in order to print an image at the resolution of 720 dpi in terms of both the primary and secondary scanning directions, all that is necessary is to print an image by causing the printing head to scan the printing medium twice on the same area in the primary direction while causing the printing head to move half a pitch in the secondary scanning direction between the first and second runs in the primary scanning direction.

(5) Structure and Operation of Heater Driver Circuit

Figure 7:
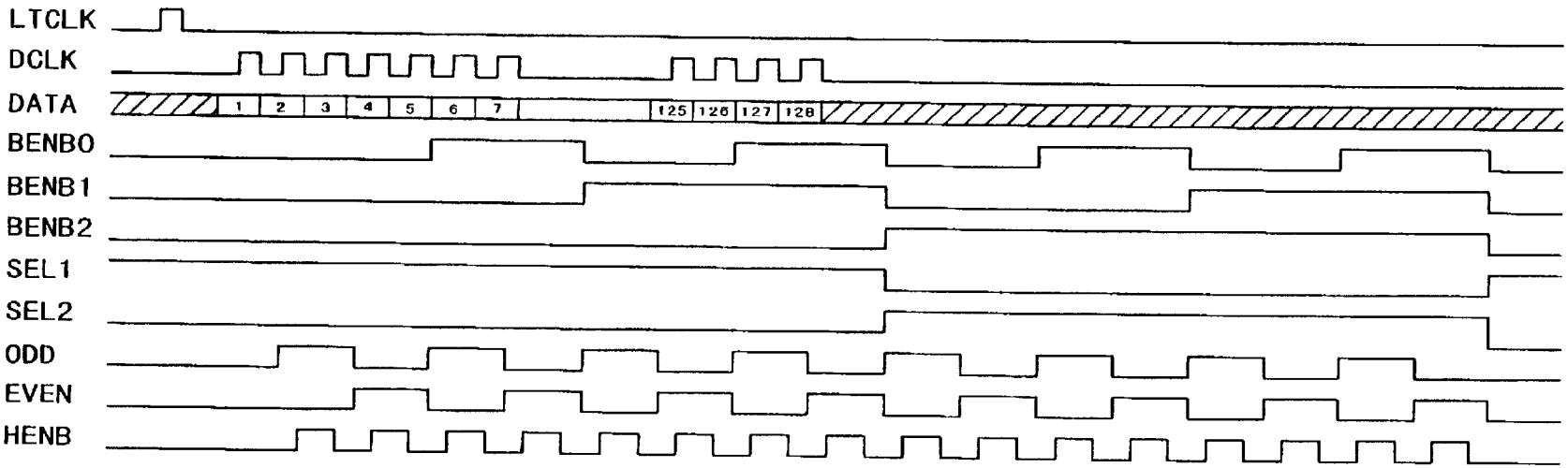
FIG. 7 is the driving timing chart for a printing operation in which the circuit illustrated in FIG. 6 is used, and resolution is 360 dpi.
Figure 8:
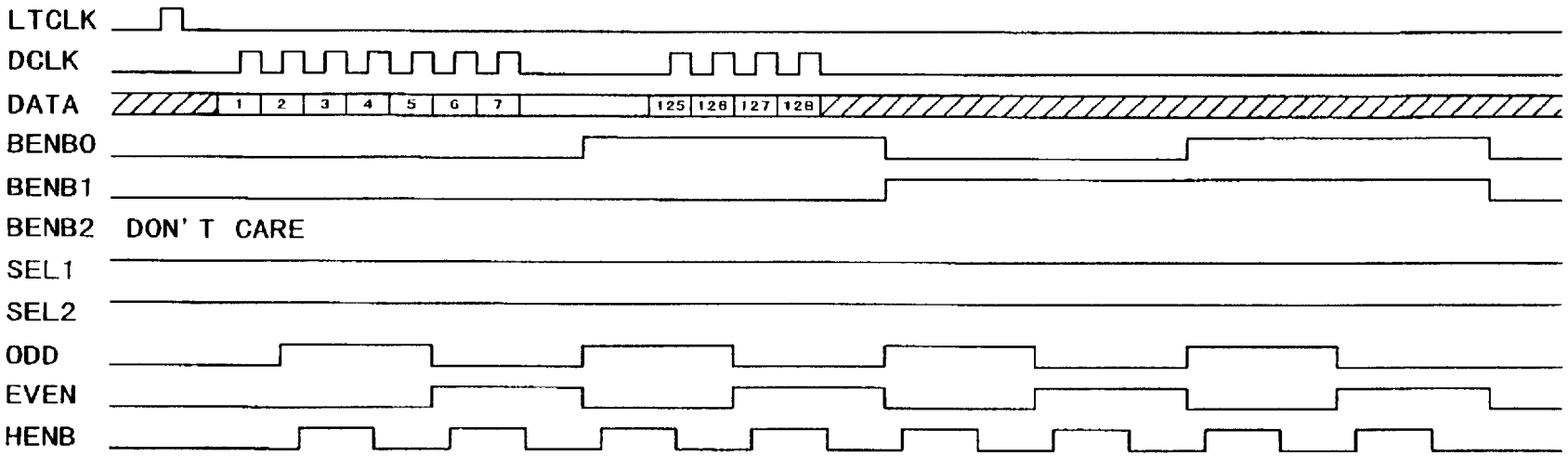
FIG. 8 is the driving timing chart for a printing operation in which the circuit illustrated in. Figure is used, and resolution is 720 dpi.

FIG. 6 is a circuit diagram of the heater driver provided in the printing head in this embodiment. FIGS. 7 and 8 are timing charts for driving the printing head at the resolutions of 360 dpi and 720 dpi, respectively.

Referential characters BENB0–BENB2 designate signals which select the blocks to be driven, and referential characters ODD and EVEN designate signals which select orifices with an odd number, and orifices with an even number, respectively. Referential characters HENB(L) and HENB(S) designate pulses which drive the large heater and the small heater, respectively.

Referring to FIG. 6, as the resolution of 360 dpi is selected, the block selection signal BENB2 is outputted without modification into a signal line SEL2, and a signal, the logic of which is reverse to the signal BENB2, is outputted into a signal line SEL1. On the other hand, as the resolution of 720 dpi is selected, the signal BENB2 is ignored, and the signal lines SEL1 and SEL2 are both activated. The signal line SEL1 is connected to every other block starting with the first block, and the signal line SEL2 is connected to every other block, staring with the second block, so that when the resolution of 360 dpi is set, the nozzles can be divided into 8 blocks, and when the resolution of 720 dpi is set, the nozzles can be divided into 4 blocks.

Referring to FIG. 5, if the resolution of 360 dpi is selected, the signals ODD and EVEN divide the nozzles into 8 blocks, each of which consists of 16 nozzles, whereas if the resolution of 720 dpi is selected, the signals ODD and EVEN divide the nozzles into 16 blocks, each of which consists of 8 nozzles. Further, if the resolution of 720 dpi is selected, the large heater driving pulse HENB(L) is masked. Therefore, the large heater is not driven, and only the small heater is driven, making it possible to produce a small dot.

Referring to FIG. 7, if the resolution of 360 dpi is selected, which of the 8 blocks are driven is determined by the block selection signals BENB0, BENB1, and BENB2, whereas if the resolution of 720 dpi is selected, the signals BENB2 is not used, and which of 4 blocks are driven is determined by signals BE0–BE3 generated by 2/4 bit decoder DEC based on two bit signals from the block selection signals BEN0 and BEN1.

In FIG. 8, the time axis is extended relative to the one in FIG. 7 for the sake of convenience, but the number of the nozzles in each block is half, and therefore, it takes only half the time to drive once all the nozzles, compared to the time it takes if the resolution of 360 dpi is selected. Therefore, if the resolution of 720 dpi is selected, ink ejected at virtually twice the frequency at which ink is ejected if the resolution of 320 dpi is selected.

In FIG. 6, a referential character S/R designates a shift register which takes in image formation data IDATA, in response to a clock signal DCLK, and aligns them with reference to nozzle position. The image formation data IDATA are serially transferred to the register S/R. A referential character LT designates a latch circuit which latches the aligned data. The circuit in FIG. 6 is provided with a logic circuit element which comprises groups of transistors which turn on or off the electrical current from power sources VH provided one for one for the heaters, groups of AND gates which selectively switch the transistors, and the like.

The head driving circuit may be provided with a terminal dedicated for receiving a resolution setting signal (360 dpi/720 dpi *), or instead, one of the other terminals of the head driving circuit may be enabled to function as the terminal for receiving the resolution signal, in addition to its primary task, as long as there is no conflict between the two tasks, provided that the printing head in accordance with the present invention is rendered interchangeable with a conventional printing head dedicated to 360 dpi. For example, if the printing head driving circuit is provided with a terminal for outputting a print head ID signal (signal outputted by a printing head to provide the control section of the apparatus main assembly with identification data such as ink ejection characteristic, ink type, and the like, so that the head can be optimally driven), this terminal may be used also as the resolution selection terminal, as long as there is no conflicts between the two usages.

The driving circuit in FIG. 6 is provided with two terminals ID0 and ID1, and the terminal ID0 is used as the resolution signal input terminal. As is evident from the drawing, the terminal ID0 is kept in the pulled-down condition in the printing head. Therefore, the printer control section 500 on the printing apparatus main assembly side reads this pulled-down condition of the terminal ID0 as "0" at the time of initialization, so that resolution can be set from the printing apparatus main assembly side by the resolution signal 360 dpi/720 dpi *. In this embodiment, the terminal ID0 is kept in the pulled-down condition so that the state of the ID0 is read as "0". In order to make the state of the terminal ID0 be read as "1", the terminal ID0 has only to be kept in the pulled-up condition, in the head.

The above described resolution setting method is effectively usable with not only the printing head in this embodiment, but also such a printing head that is interchangeable with a head dedicated for 360 dpi. For example, it is effectively usable with a printing head which can carry out two functions: a printing function carried out by its printing head portion, the ejection orifices of which are aligned for the resolution of 360 dpi, and a scanning function, as an additional function, carried out by its reading head portion (reading resolution can be controlled).

As is evident from the above description of in this embodiment, according to the present invention, two or more degrees of printing resolution can be realized with the use of a single printing head. Therefore, resolution can be changed as necessary so that prints with optimum quality can be produced. In other words, all that is necessary is to select a high degree of resolution when high quality is required, or to select a relatively low degree of resolution when high printing speed is required.

When an image is printed at twice the normal resolution, the time it takes to drive once all the nozzles is half the time it takes at the normal resolution. Therefore, the throughput reduction which occurs at twice the normal resolution is equivalent to the scanning speed loss in the secondary scanning direction. In other words, the throughput is reduced by only one half.

Further, since whatever degree of resolution is selected, the ejection nozzles are serially driven, the cross talk is suppressed, and it is unnecessary to choose an electrical power source with a relatively large capacity, as the electrical power source for driving the printing head.

Further, one of the terminals, the secondary usage of which does not create any problem, is used also as the resolution selection terminal (in this embodiment, the ID terminal is used also as the resolution selection terminal). Therefore, it is possible to prevent the increase in the number of the terminals of the printing head.

Embodiment 2

The present invention is applicable to not only a printing head such as the one illustrated in FIG. 5, but also a printing head different from the one illustrated in FIG. 5.

Figures 9A, 9B:
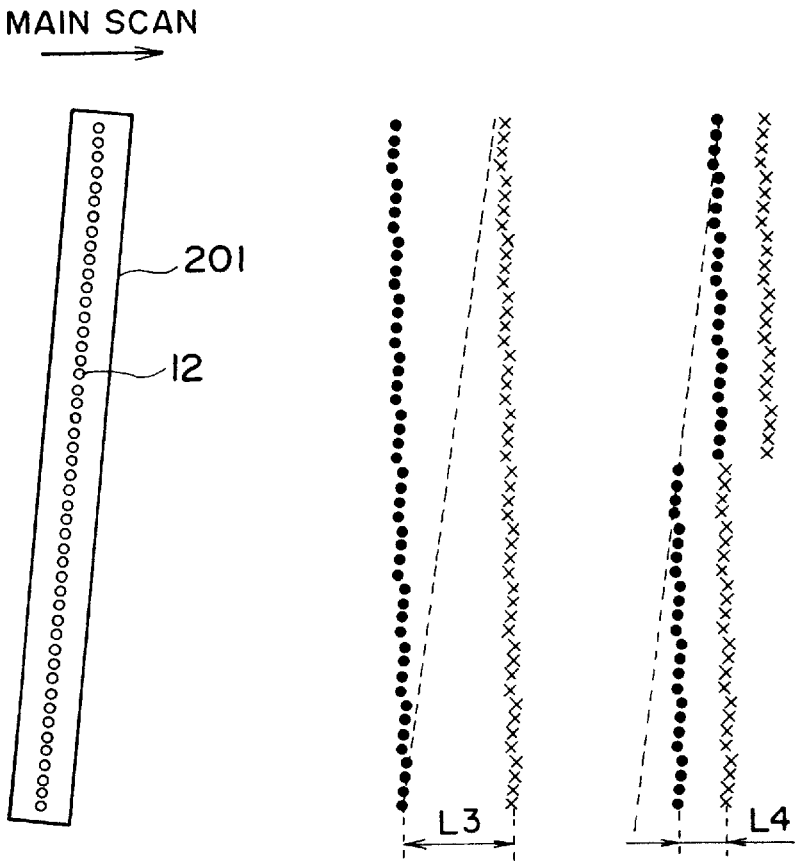
FIG. 9 is a drawing which depicts the general structure, positioning, and printing operation, of the printing head in the second embodiment of the present invention.

FIG. 9 is a drawing which depicts the structure and operation of the printing head in the second embodiment of the present invention.

The printing head in FIG. 9 is provided with 48 ejection nozzles, which are divided into 12 blocks, each of which comprises four nozzles driven at the same time. FIG. 9, (a) depicts the dot alignment which occurs when all 48 ejection nozzles of this printing head are driven to realize the resolution of 360 dpi. The dots represented with "x" marks represent the dots created when the ejection nozzles are activated to create the next column of dots. A referential character L3 designates the dot pitch at 360 dpi.

FIG. 9, (b) depicts the dot alignment when the same printing head as the one used to create the dot alignment in FIG. 9, (a), is used to print at 720 dpi. In this case, the dot pitch L3 for the resolution of 360 dpi, is reduced to a dot pitch L4, or the dot pitch for the resolution of 720 dpi, by changing the 12 blocks based driving method to the 6 blocks based driving method in which the 12 blocks are divided into the top group which consists of 6 blocks, each of which consists of 4 nozzles, and the bottom group which also consists of 6 blocks, each of which consists of 4 nozzles, and driving the blocks in ordinally correspondent pair, that is, one in the top group and one in the bottom group, thus driving 8 nozzles at the same time.

Miscellaneous Embodiments

The present invention is applicable to not only the above described ink jet printing apparatus, but also, various other apparatuses, as long as the apparatuses to which the present invention is applied are provided with a plurality of printing elements. Further, the present invention produces excellent results when it is applied to an ink jet printing head, or an ink jet printing apparatus, which are provided with means (for example, electrothermal transducers, laser beam generating elements, and the like) for generating thermal energy as the energy used for ink ejection, and changes the state of ink with the use of the thermal energy generated by the thermal energy generating means. This is because such a printing system can record in higher resolution to produce highly precise images.

As for the structure and operational principle of the printing head or printing apparatus, it is desired that the basic principle disclosed in the specifications of, for example, U.S. Pat. Nos. 4,723,129, and 4,740,796 is employed. Although this system is applicable to either the so-called on-demand type or the continuous type, it is more effective when applied to the latter, for the following reason. That is, in the case of the former, or the on-demand type system, electrothermal transducers are positioned in contact with a sheet of material in which ink is retained, or positioned in liquid paths filled with ink. In printing, at least one driving signal, which is capable of causing the electrothermal transducer to generate thermal energy powerful enough to increase the temperature of the ink adjacent to the electrothermal transducer, beyond the level at which the so-called film boiling of the ink occurs, is applied to each of the electrothermal transducers selected in accordance with recording data, or image formation data, generating bubbles, one bubble for one driving signal, in the liquid path. Then, as each bubble grows and contracts, liquid (ink) is ejected through the ejection orifice, forming at least one liquid droplet. The driving signal is desired to be in the form of a pulse because the driving signal in the form of a pulse can cause a bubble to properly, that is, instantly, grow and contract, in other words, the ink is ejected with faster response. Examples of the desirable driving signal in the form of a pulse are those disclosed in the specifications of U.S. Pat. Nos. 4,463,359, and 4,345,262. Further, if the conditions disclosed in the specifications of U.S. Pat. No. 4,313,124 regarding the rate of the temperature increase at the heat transferring interface between the aforementioned electrothermal transducer and the ink, is adopted in addition to the application of the present invention, far superior images can be recorded.

In addition to recording heads in which the ejection orifices, liquid paths (straight or perpendicularly bent), and electrothermal transducers, are disposed in the above described combination at the above described locations, the present invention is also applicable to recording heads with the structure disclosed in the specifications of U.S. Pat. Nos. 4,558,333 and 4,459,600, in which the thermal transfer interface portion is positioned at the bend of the liquid path. In other words, the present invention assures that recording can effectively be made regardless of printing head structure.

Further, the present invention can also be effectively applied to a full-line type recording head, that is, a recording head, the length of which matches the maximum width of the largest image recordable on the largest piece of recording medium usable with the full-line type recording apparatus in which the full-line type recording head is employed, as long as the ejection nozzles of the full-line type recording head are serially driven. Such a recording head may comprise a plurality of shorter recording heads, the combined length of which matches the width of the aforementioned largest image, or may be simply a recording head in a single piece.

The present invention is applicable to a recording head fixed to the main assembly of a recording apparatus, a replaceable chip type recording head, which is electrically connected to the recording apparatus main assembly, and is enabled to be supplied with ink from the apparatus main assembly, as it is mounted into the apparatus main assembly, and a cartridge type recording head which integrally comprises an printing head portion and an ink container portion, as long as these recording heads are of the type in which the ejection nozzles are serially driven.

The present invention is a printing apparatus provided with various forms of means, as one of the structural components other than the printing means, to restore the liquid ejecting performance of the recording head (inclusive of auxiliary means, and the like). More specifically, the present invention is compatible a printing apparatus equipped with a means for capping a recording head, a recording head cleaning means such as a cleaning blade, a means for removing ink through an ejection orifice by pressurizing an ink supplying system or by sucking it out, a means for preliminarily heating the portions of a recording head pertaining to ink ejection, with the use of the aforementioned electrothermal transducers, heating elements other than the portions of a recording head pertaining to ink ejection, or the combination of the former and the latter, and a means for preliminarily ejecting liquid for the purposes other than recording.

The present invention is very effectively applicable to the above described recording apparatuses regardless of the type and number of recording heads which are mounted into the apparatus main assembly. For example, a recording apparatus may be provided with only a single head which ejects only single liquid of a specific color, or a plurality of recording heads, which are individually assigned to inks of different colors and densities. In other words, a recording apparatus may be provided with only a single recording mode in which recording is made with ink of only a primary color such as black, or a plurality of recording modes, for example, a mode in which printing is made with two or more inks of different colors, or a mode in which printing is made in full-color with the combined use of the inks of different colors.

In the preceding description of the embodiments of the present invention, ink was described as liquid ink. However, the present invention is also compatible with a printing apparatus which uses such ink that remains in the solid state below the normal room temperature, and softens at the normal room temperature or above. In an ink jet system, it is a common practice to control ink temperature itself so that it remains within a range of 30° C. to 70° C., that is, the range in which ink viscosity remains suitable for stable ink ejection. Therefore, such ink that liquifies as a recording signal is applied may be used. Further, the ink which remains in the solid state when no heat is applied, and liquefies when heat is applied, may be used to eliminate the problems traceable to ink evaporation, and also to positively use the temperature increase caused by the thermal energy applied to eject ink, as the energy for changing the state of ink from solid to liquid. To sum up, the present invention is also applicable to a printing apparatus which uses ink, the nature of which is such that it liquifies only when thermal energy is applied to it, for example, ink which is liquified by the thermal energy generated by a recording signal, is ejected as liquid ink, and begins to solidify by the time it reaches the recording medium. The present invention is most effective when it is applied to a printing apparatus which uses the aforementioned ink ejection system based on the so-called film-boiling of ink, and one of the above described inks.

As for a printing apparatus to which the present invention is applicable, there are various forms of ink jet recording apparatuses, in addition to the ink jet recording apparatus in the form of an image outputting terminal for an information processing device such as a computer, for example, an ink jet recording apparatus in the form of a copying apparatus combined with a reader, an ink jet recording apparatus in the form of a facsimile apparatus with both transmitting and receiving functions, and the like.

As described above, according to the present invention, various degrees of resolution can be realized with the use of a single recording head in which a plurality of ejection orifices are aligned in a predetermined manner. Therefore, requirements from a user, in terms of resolution, throughput, and the like, can be properly dealt with.

While the invention has been described with reference to the structures disclosed herein, it is not confined to the details set forth, and this application is intended to cover such modifications or changes as may come within the purposes of the improvements or the scope of the following claims.

What is claimed is:

1. A print head capable of printing with different resolutions, comprising:

a plurality of printing elements for applying ink on a printing material, wherein amounts of ink ejected from said printing elements are changeable, respectively, and said printing head is movable relative to said printing material in the moving direction;

divided-driving means for driving said printing elements, wherein said printing elements are grouped into a plurality of groups, and said divided-driving means drives said printing elements by groups; and drive changing means for changing the number of groups into which said printing elements are grouped and the amounts of the ink ejected from printing elements in accordance with the print resolution to change print pitch in said moving direction, wherein said drive changing means operates such that when the resolution is relatively high, the number of groups is relatively larger, and the amounts of ejection are adjusted accordingly.

2. A print head according to claim 1, wherein each of said printing elements includes a plurality of means for generating energy for applying the ink, and wherein modulating means selectively drives said plurality of energy generating means.

3. A print head according to claim 1, wherein said print head includes means for accepting an external signal for changing the print resolution.

4. A print head according to claim 1, wherein each of said printing elements includes an ejection outlet for ejecting the ink, and energy generating elements for ejecting the ink.

5. A print head according to claim 4, wherein said energy generating element includes an electrothermal transducer.

6. A print head according to claim 5, wherein said electrothermal transducer causes a film boiling in the ink.

7. A print head according to claim 5, wherein said energy generating element includes an electrothermal transducer.

8. A printing apparatus comprising carriage means for carrying said print head as defined in claim 1, and means for moving said carrying means in a direction different from a direction along which said printing elements are arranged.

9. An apparatus according to claim 8, further comprising means for supplying a signal for changing the drive timing.

10. A print system comprising means for supplying image data to said print apparatus defined in claim 9, and means for setting the resolution when the image data is printed.

11. A print method comprising:

a step of moving, relative to the print material, said print head defined in claim 1 in a direction different from a direction along which said printing elements are arranged; and changing drive of said plurality of printing elements in accordance with a print resolution during said moving step.

12. A printing apparatus comprising:

a plurality of printing elements for applying ink on a printing material;

means for moving said print head relative to said printing material in a moving direction;

divided-driving means for driving said printing elements, wherein said printing elements are grouped into a plurality of groups, and said divided-driving means drives said printing elements by groups; and drive changing means for changing the number of groups into which said printing elements are grouped and the amounts of the ink ejected from printing elements in accordance with the print resolution to change print pitch in said moving direction, wherein said drive changing means operates such that when the resolution is relatively high, the number of groups is relatively larger, and the amounts of ejection are adjusted accordingly.

13. A printing apparatus according to claim 12, wherein each of said printing elements includes a plurality of means for generating energy for applying the ink, and wherein modulating means selectively drives said plurality of energy generating means.

14. A printing apparatus according to claim 12, further comprising means for accepting from a host side a signal for changing the print resolution.

15. A printing apparatus according to claim 12, wherein each of said printing elements includes an ejection outlet for ejecting the ink, and energy generating elements for ejecting the ink.

16. A printing method comprising:

a step of preparing a print head capable of printing with different resolutions, including a plurality of printing elements for applying ink on a printing material, wherein the print head is movable relative to the printing material in a moving direction; and a step of changing the numbers of blocks into which the printing elements are grouped and the amounts of the ink ejected from printing elements in accordance with the print resolution to change print pitch in the moving direction, wherein, in said changing step, when the resolution is relatively high, the number of groups is relatively larger, and the amounts of ejection are adjusted accordingly.

17. A printing apparatus comprising:

means for carrying and moving a recording head having a plurality of printing elements and capable of ejecting ink with different amounts of ejection;

divided-driving means for driving said printing elements, wherein said printing elements are grouped into a plurality of groups, and said divided-driving means drives said printing elements by groups in a time-sharing manner; and drive changing means for changing the number of groups into which said printing elements are grouped and the amounts of the ink ejected from said print head in accordance with the print resolution to change print pitch in said moving direction, wherein said drive changing means operates such that when the resolution is relatively high, the number of groups is relatively larger, and the amounts of ejection are adjusted accordingly.

18. A printing apparatus comprising carriage means for carrying said print head as defined in claim 17, and means for moving said carrying means in a direction different from a direction along which said printing elements are arranged.

19. A printing apparatus according to claim 17, wherein said printing elements of said print head are inclined relative to a scanning direction of said print head.

* * * * *

UNITED STATES PATENT AND TRADEMARK OFFICE

CERTIFICATE OF CORRECTION

PATENT NO. : 6,582,041 B1
DATED : June 24, 2003
INVENTOR(S) : Yuji Tsuruoka

It is certified that error appears in the above-identified patent and that said Letters Patent is hereby corrected as shown below:

Column 1,
Line 17, “Jet” should read -- jet --.

Column 14,
Line 4, “liquefies” should read -- liquifies --; and
Line 16, “film-boiling” should read -- film boiling --.

Signed and Sealed this

Thirtieth Day of September, 2003

JAMES E. ROGAN
*Director of the United States Patent and Trademark Office*